United States Patent [19]

Wochnowski et al.

[11] 4,195,647

[45] Apr. 1, 1980

[54] METHOD AND APPARATUS FOR INCREASING THE VOLUME OF TOBACCO OR THE LIKE

[75] Inventors: Waldemar Wochnowski, Hamburg; Willi Thiele, Geesthacht, both of Fed. Rep. of Germany

[73] Assignee: Hauni-Werke Korber & Co. KG., Hamburg, Fed. Rep. of Germany

[21] Appl. No.: 936,203

[22] Filed: Aug. 24, 1978

[30] Foreign Application Priority Data

Sep. 3, 1977 [GB] United Kingdom ..... 37040/77

[51] Int. Cl.[2] ..... A24B 3/18

[52] U.S. Cl. ..... 131/140 P; 131/143

[58] Field of Search ..... 131/140 R, 140 P, 143, 131/133; 34/31, 20, 30

[56] References Cited

U.S. PATENT DOCUMENTS

| | | | |
|---|---|---|---|
| 3,524,452 | 8/1970 | Moser et al. | 131/140 P |
| 3,612,066 | 10/1971 | Jones et al. | 131/140 P |
| 3,683,937 | 8/1972 | Fredrickson et al. | 131/140 P |
| 3,760,816 | 9/1973 | Wochnowski | 131/140 R |
| 3,788,331 | 1/1974 | Neel et al. | 131/140 P X |
| 3,985,145 | 10/1976 | Broscheit et al. | 131/140 R X |
| 4,004,594 | 1/1977 | Wochnowski et al. | 131/140 R X |

*Primary Examiner*—Stephen C. Pellegrino

*Attorney, Agent, or Firm*—Peter K. Kontler

[57] ABSTRACT

Shreds of tobacco are conveyed across a rising stream of saturated steam and in a shower of hot water droplets so that the temperature and moisture content of shreds increase to a value at which the shreds are pliable. The shreds are thereupon introduced into a drying unit wherein they rise and fall while moving across a rising stream containing a mixture of superheated water vapors and hot air to be alternately subjected to more and less pronounced drying action which causes pronounced crimping of the shreds. The dried shreds are immediately cooled to room temperature prior to admission into the magazine of a cigarette maker.

38 Claims, 3 Drawing Figures

METHOD AND APPARATUS FOR INCREASING THE VOLUME OF TOBACCO OR THE LIKE

BACKGROUND OF THE INVENTION

The present invention relates to a method and apparatus for conditioning and drying tobacco or other smokable materials. More particularly, the invention relates to improvements in a method and apparatus for increasing the volume of fibers consisting of tobacco or another material which can be used as a filler for cigarettes, cigarillos, cigars or analogous smokers' products. The term "fibers" is intended to denote fragments of smokable material which are obtained by severing (shredding) and/or tearing or ripping and which are to be converted into fillers of cigarettes, cigars or cigarillos or into the contents of packages for pipe tobacco or the like. The material of the fibers may be natural or reconstituted tobacco or a substitute, e.g., an artificial substance made of cellulose.

Manufacturers of smokers' products strive to treat shreds or otherwise configurated fragments of smokable material (hereinafter called tobacco with the understanding, however, that such material also embraces reconstituted tobacco and/or tobacco substitutes) in such a way that the filling capacity or property of tobacco is as high as possible. This enhances the appearance of finished smokers' products, i.e., when a cigarette containing a satisfactory filler is gripped by the fingers of the smoker, the smoker gains the impression that the filler is firm. The filling capacity or volume of a batch or mass of tobacco can be increased by puffing (i.e., by increasing the volume of discrete fibers or fragments of tobacco) and/or by crimping (the volume of a body of tobacco consisting of crimped shreads greatly exceeds the volume of a body of tobacco consisting of the same number of straight shreds).

It is already known to increase the volume of a mass of tobacco particles (e.g., tobacco shreds) during transport of moist tobacco in the pneumatic conveyor of a so-called flow dryer wherein the particles are contacted by a hot air stream whose moisture content is low (1 to 1.5 parts per weight of water vapors for 10 parts per weight of air). The path along which the particles are pneumatically conveyed is sufficiently long to insure that their moisture content is reduced to a desired value.

It is further known to increase the volume of tobacco (i.e., to subject tobacco to a so-called puffing action) by conveying a stream of tobacco particles in fluidized condition across a stream of water or steam so as to raise the moisture content of tobacco to approximately 60 percent. This results in pronounced swelling of tobacco particles. The particles are thereupon subjected to a rapid and pronounced drying action, e.g., on contact with dry air or by resorting to a source of microwave energy, to thus insure that the volume of tobacco particles is not reduced all the way back to the initial value.

A drawback of such methods is that they are time-consuming and also that the treatment must be carried out by resorting to complex, bulky and expensive apparatus.

OBJECTS AND SUMMARY OF THE INVENTION

An object of the invention is to provide a novel and improved method of increasing the volume of a mass of particles consisting of tobacco and/or another material which can be used for the manufacture of smokers' products.

Another object of the invention is to provide a method which can be practiced by resorting to a relatively simple, compact and inexpensive apparatus.

A further object of the invention is to provide a method which can be resorted to for increasing the volume of a mass of tobacco particles or the like to a value greatly exceeding the volume of tobacco particles which are treated in accordance with heretofore known puffing or analogous methods.

An additional object of the invention is to provide a method which can be practiced to increase the volume of large quantities of tobacco per unit of time, which insures that the particles are not subjected to pronounced comminuting action, and which does not necessitate excessive moistening of tobacco or the like for the purpose of increasing the volume to a value higher than that which can be achieved by resorting to heretofore known methods.

A further object of the invention is to provide a novel and improved apparatus for the practice of the above outlined method.

Another object of the invention is to provide the apparatus with novel and improved means for conditioning, drying and cooling particles of tobacco or other smokable material.

One feature of the invention resides in the provision of a method of increasing the filling capacity of fibers which consist of smokable material, particularly tobacco, prior to confinement of fibers in containers or receptacles, such as tubular wrappers of cigarettes, cigars or cigarillos, packs for smoking tobacco or the like. The method comprises the steps of raising the moisture content of and simultaneously heating the fibers to increase their pliability or flexibility (the step of raising the moisture content preferably includes abruptly raising the moisture content of fibers by at least 25 percent, e.g., by 50 percent within an interval of a few seconds), and thereupon drying the fibers including alternately expelling moisture from the fibers in rapid sequence at a higher and lower rate per unit of time. For example, the drying step may comprise alternately expelling moisture from the fibers at a first rate which exceeds zero and at a second rate which equals or approximates zero. It is also possible to carry out the drying step as follows: The fibers are alternatively caused to lose moisture and to acquire moisture (i.e., moisture is alternately expelled from and supplied to the fibers). However, the amount of moisture which is added to the fibers in the course of acquisition of moisture (wetting) is less than (and preferably a minute fraction of) the amount of moisture which is withdrawn from fibers during expulsion so that, upon completion of the drying step, the moisture content of fibers is invariably less than prior to the drying step.

The step of raising the moisture content of and simultaneously heating the fibers may comprise contacting the fibers with flowing steam and with finely dispersed droplets of hot water (such water can be sprinkled onto the fibers while the fibers are contacted by flowing steam). The steam is preferably saturated (to further enhance the wetting action) and the temperature of hot water is preferably between 50° and 90° C. It is further preferred to agitate the fibers during contact with steam and water droplets (such agitating step can be carried out by conveying the fibers on a foraminous vibratory conveyor and by directing saturated steam against the underside of the conveyor so that the fibers are intermittently lifted by the ascending streamlets of steam which penetrate through the apertures of the vibratory conveyor). The agitating step contributes to rapid and uniform moistening and heating of the fibers.

The drying step preferably comprises contacting the fibers with a fluid stream including a mixture of a hot gas (preferably air) and superheated water vapors. The stream has first and second portions wherein the drying effect of the mixture upon the fibers is respectively more pronounced and less pronounced, and the drying step then further comprises alternately contacting the fibers with the first and second portions of the stream in rapid sequence. The initial or starting temperature of the stream (i.e., the temperature of those increments of the stream which are about to contact the fibers) is preferably between 150° and 210° C., and the initial moisture content of the stream is preferably between 200 and 400 grams per kilogram of dry gas (air). The drying effect of the second portion of the stream can be selected in such a way that it equals or approximates zero. Alternatively, the drying effect of the second portion of the stream can be selected in such a way that it is slightly negative (i.e., the fibers receive moisture from the second portion of the stream). However, the drying effect of the first portion of the stream is invariably more pronounced than the negative drying (wetting) effect of the second portion of the stream so that, upon completion of the drying step, the moisture content of fibers is invariably less than the moisture content of fibers prior to drying.

The aforementioned stream which contains a hot gas and superheated water vapors can be conveyed upwardly; the second portion of the stream is then located at a level above the first portion because the stream is cooled as a result of initial contact with fibers and also because some of the vapors condense on contact with the fibers. As mentioned above, the drying effect of the second (higher) portion of the stream can equal or approximates zero; alternatively, and as also mentioned above, the second portion may produce a negative drying (wetting) effect. However, the drying effect in the lower portion of the stream is more pronounced than the wetting effect in the upper portion so that the overall moisture content of fibers upon completion of the drying step is less than prior to drying.

The fibers can receive mechanical impulses during contact with the stream, i.e., with a flowing fluid consisting of the aforementioned mixture of hot gas and superheated water vapors; such impulses serve to move (or to assist the movement of) the fibers between the first and second portions of the stream. For example, and if the mechanical impulses are imparted by a vibratory conveyor, the conveyor can cause the fibers to rise into the upper portion of the stream, to thereupon descend into the lower portion by gravity, to again rise on receipt of a fresh mechanical impulse as well as under the action of ascending fluid, and so forth. It is also possible to convey the stream in a predetermined direction (e.g., upwardly) at a periodically varying speed so that the stream pulsates during contact with the fibers.

If desired, the drying step can be carried out as follows: The stream consisting of a mixture of hot gas and water vapors is conveyed in a predetermined direction (e.g., upwardly) and its cross-sectional area is increased, as considered in the just mentioned direction, so that the speed of the stream decreases. The fibers are conveyed across the stream (e.g., along a substantially horizontal path) whereby the fibers alternately rise and fall in rapid sequence during movement across the stream as a result of divergence of the stream in the aforementioned direction. The second portion of the stream is then located at a level above the first portion so that the fibers are subjected to less pronounced drying action while they rise (and, of course, also in their uppermost positions) and to a more pronounced drying action as they fall in the stream (and, of course, in their lowermost positions).

The method preferably further comprises the step of cooling the fibers upon completion of the drying step, preferably immediately upon completion of drying and preferably by contacting the fibers with a cool gas (particularly air). The cooling step may comprise establishing a turbulent layer (fluidized bed) of a cool gas (e.g., along the upper side of a substantially horizontal vibratory conveyor) and conveying the fibers through the layer, namely, in the longitudinal direction of and above the vibratory conveyor).

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
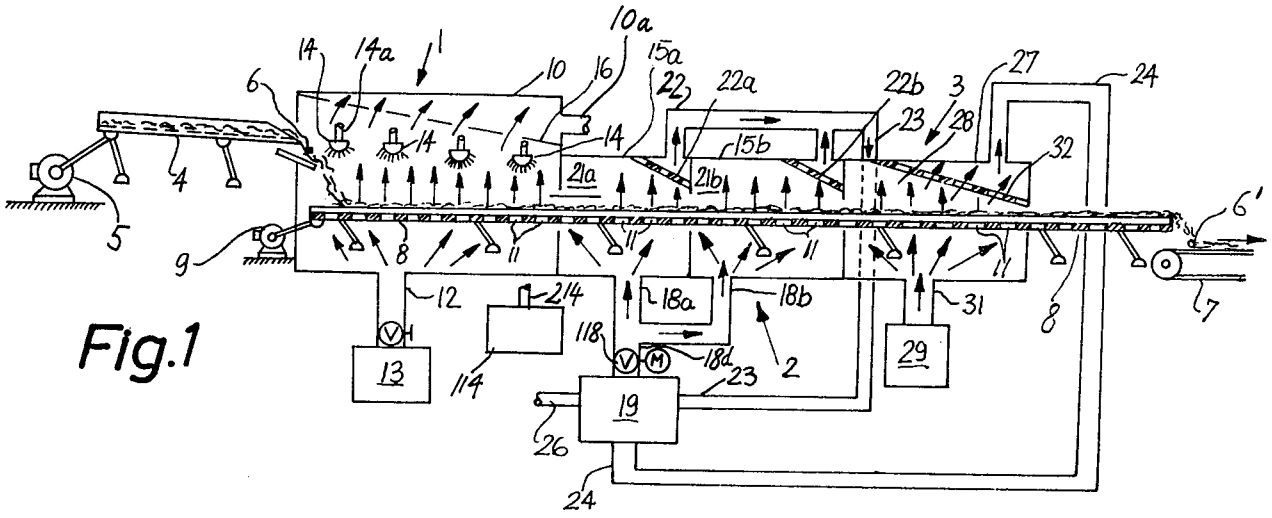
FIG. 1 is a schematic partly elevational and partly longitudinal vertical sectional view of an apparatus which embodies the invention.

The apparatus of FIG. 1 comprises a first (conditioning) unit 1 wherein fibers 6 of tobacco are subjected to an abrupt and intensive wetting action to rapidly raise their moisture content (preferably by at least 25 percent) and wherein the fibers 6 are further contacted by several sprays of a hot liquid, preferably water. The unit 1 receives a continuous stream of tobacco fibers 6 from a trough 4 which is vibrated by a motor 5 so as to cause the stream of fibers 6 to advance in a direction to the right, as viewed in FIG. 1. The conditioning unit 1 is followed by a drying unit 2 wherein the moisture content of fibers 6 is reduced in a novel and improved way, and the drying unit 2 is followed by a cooling unit 3 wherein the temperature of dried fibers 6 is reduced to (or close to) room temperature. The drying uint 3 discharges cooled fibers 6' onto the upper reach of a belt conveyor 7 which transports the stream of fibers to a further processing station, e.g., to one or more cigarette making machines wherein the fibers are converted into rod-like fillers ready to be draped in webs of cigarette paper to form therewith continuous cigarette rods. Each rod is severed at regular intervals to yield a succession of discrete plain cigarettes of unit length or multiple unit length. It is clear that the conveyor 7 can deliver fibers to a cigar maker or cigarillo maker or to a machine wherein predetermined quantities of tobacco fibers are introduced into containers for smoking tobacco.

The conditioning unit 1 comprises a chamber 10 which confines the left-hand portion of an elongated substantially horizontal vibratory conveyor 8 driven by an electric motor 9 through the medium of a suitable eccentric. The conveyor 8 is similar to the vibratory conveyor which is shown in FIG. 1 of commonly owned U.S. Pat. No. 3,957,063 granted May 18, 1976 to Wochnowski. The bottom wall of the conveyor 8 has apertures 11 which permit streamlets of a fluid to rise and to penetrate through the stream of tobacco fibers 6 which are caused to advance along the upper side of the bottom wall in a direction from the trough 4 toward the drying unit 2. A source 13 of saturated steam is connected with the lower portion of the chamber 10 by a supply conduit 12 which conveys saturated steam in the direction indicated by arrow. The upper portion of the chamber 10 contains several spray nozzles 14 which discharge finely atomized droplets of a warm liquid (preferably hot water) onto the stream of fibers 6 which advance along the upper side of the bottom wall of the vibratory conveyor 8. The temperature of water which issues from the nozzles 14 is preferably between 50° and 90° C. A sieve or screen 16 in the upper portion of the chamber 10 serves to intercept lighter fibers 6 which are entrained by the ascending fluid (steam). Spent steam leaves the upper portion of the chamber 10 via conduit 10*a*.

The conveyor 8 imparts to the fibers 6 mechanical impulses, i.e., the fibers are propelled upwardly which results in loosening of the constituents of the tobacco stream. Additional loosening is effected by the streamlets of steam which rise through the apertures 11 and intimately contact all sides of each and every fiber 6 in the region above the upper side of the bottom wall of the conveyor 8. The major part of steam condenses on the fibers 6; therefore, the speed of steam above the tobacco stream in the chamber 10 decreases. This results in development of a turbulent layer above the bottom wall of the conveyor 8, and the fibers 6 float as well as rise and fall in the layer on their way toward the drying unit 2. It will be noted that the direction of travel of the stream of tobacco fibers 6 in the chamber 10 is substantially at right angles to the direction of flow of steam from the supply conduit 12 into the upper portion of the chamber 10 and thence into the conduit 10*a*.

The just described construction of the conditioning unit 1 insures that the fibers 6 undergo an intensive and uniform wetting and heating action (normally, the moisture content of conditioned fibers 6 which leave the chamber 10 is between 25 and 40 percent and the temperature of such fibers is between 50° and 70° C.). Wetting and simultaneous heating enhances the pliability of flexibility of fibers 6 which is an optimum state or starting condition prior to begin of the drying step.

The reference character 114 denotes a source of hot water (e.g., a water tank which is provided with a resistance heater or the like to maintain the temperature of the supply of water therein within the desired range). The source 114 is connected with the pipes 14*a* for spray nozzles 14 by a conduit 214.

The supply conduit 12 contains a valve 112 which can be adjusted to regulate the rate and/or velocity of flow of steam from the source 13 into the lower portion of the chamber 10.

The drying unit 2 comprises at least one but preferably two chambers 15*a* and 15*b* which are disposed one behind the other, as considered in the direction of transport of the tobacco stream, and which confine an intermediate portion of the vibratory conveyor 8. The lower portions of the chambers 15*a*, 15*b* (i.e., the portions below the bottom wall of the conveyor 8) respectively communicate with the discharge ends of supply conduits or pipes 18*a*, 18*b* for streams of a fluid constituting a mixture consisting of hot gas (preferably air) and superheated steam (water vapors). The temperature of such mixture in the conduits 18*a*, 18*b* is preferably between 150° and 210° C., and the mixture which is about to contact the fibers 6 in the chambers 15*a* and 15*b* preferably contains between 200 and 400 grams of water per kilogram of dry air. The mixture is furnished by a suitable source 19, e.g., a steam generator which receives preheated air from the cooling unit 3 via conduit 24 and steam from the chambers 15*a*, 15*b* via conduits 22, 23.

The side walls 21*a*, 21*b* of the chambers 15*a*, 15*b* diverge immediately above the bottom wall of the conveyor 8. FIG. 1 merely shows one side wall 21*a* and one side wall 21*b*; however, the manner in which the side walls of the chambers 15*a*, 15*b* diverge can be readily understood by referring to FIG. 2 of the aforementioned commonly owned U.S. Pat. No. 3,957,063 which is incorporated herein by reference. The divergent side walls 21*a* and 21*b* cause the ascending streams of the mixture of hot air and steam to flow, at a decreasing speed, toward and into the conduits 22 and 23 which respectively communicate with the uppermost portions of the chambers 15*a* and 15*b*. The fibers 6 which travel along the upper side of the bottom wall of the vibratory conveyor 8 receive mechanical impulses and are thereby subjected to a further loosening action. Streamlets of the mixture of hot air and superheated water vapors which rise in the chambers 15*a*, 15*b* and flow through the apertures 11 of the conveyor 8 also contribute to loosening action and intimately contact the fibers 6 during travel in the divergent portions of their paths, i.e., between the side walls 21*a* and 21*b*. The mixture forms a turbulent layer which is adjacent to the upper side of the bottom wall of the conveyor 8 and wherein the fibers 6 advance toward the cooling unit 3.

The mixture which rises above the walls 21*a*, 21*b* of the chambers 15*a*, 15*b* respectively passes through the orifices or perforations of tobacco-intercepting sieves or screens 22*a*, 22*b* prior to entering the inlets of the pipes 22, 23. The pipe 22 delivers the mixture to the pipe 23 which, in turn, supplies the mixture to the steam generator 19. The latter changes the condition of the mixture so that the mixture can be readmitted into the conduits 18*a*, 18*b* for introduction into the lower portions of the chambers 15*a* and 15*b*. As mentioned above, fresh air which is necessary for satisfactory operation when the mixture is circulated through the drying unit 2, back to the steam generator 19 and again into the chambers 15*a*, 15*b* is furnished by the pipe 24 which collects spent (preheated) air that is used to cool the fibers 6 during travel through the cooling unit 3. The steam generator 19 is further provided with an outlet 26 which discharges a certain amount of mixture into the surrounding atmosphere; such amount is replaced by preheated air which is admitted via conduit 24.

A valve 118 in the conduit 18*d* which supplies fluid to the conduits 18*a* and 18*b* can be driven by a motor M to intermittently change the rate and/or velocity of flow of fluid into the chambers 15*a*, 15*b*. The admission of fluid in pulsating fashion when the motor M is on further enhances the loosening and drying action in the unit 2.

The speed at which the mixture flows in the chambers 15*a* and 15*b* is preferably selected in such a way that the fibers 6 can cover substantial distances while they rise and fall on their way through the drying unit 2. The upper portion of the stream which rises in the chambers 15, 15*b* is cooler than the lower portion immediately above the bottom wall of the conveyor 8, i.e., the drying effect of the upper portion of the stream is less pronounced than the drying effect of the lower portion. Thus, as the fibers 6 alternately rise and fall in rapid sequence during movement through the chambers 15*a* and 15*b*, they are alternately contacted by the second and first portions of the mixture so that they are alternately subjected to a less pronounced and to a more pronounced drying action. The mixture is relatively dry and relatively hot immediately above the bottom wall of the conveyor 8 so that it can subject the fibers to an intensive drying or moisture-expelling action. On the other hand, the mixture which is adjacent to the undersides of the sieves or screens 22*a*, 22*b* is relatively cold and its moisture content is high (due to withdrawal of moisture from fibers 6 in the region immediately above the bottom wall of the conveyor 8) so that the drying or moisture expelling effect of the mixture in the upper portions of the chambers 15*a*, 15*b* is less pronounced. On its way through the drying unit 2, each fiber 6 (or at least the great majority of fibers) repeatedly rises to a level close to the undersides of the sieves 22*a*, 22*b* to thereupon descend by gravity to a lower level, i.e., into contact with or close to the bottom wall of the conveyor 8.

The construction and mode of operation of the conveyor 8 can be readily selected in such a way that the conveyor promotes the movements of fibers 6 between upper and lower levels. Thus, at least one of the parameters including the frequency of vibrations of the conveyor 8, the amplitude of vibrations and the direction in which the bottom wall of the conveyor 8 propels the fibers 6 can be adjusted or selected in such a way that the drying effect of the mixture in the chambers 15*a*, 15*b* in the region close to the sieves 22*a*, 22*b* is negligible, zero or negative (i.e., that the fibers 6 which rise in the drying unit 2 are subjected to a slight wetting action by withdrawing moisture from the surrounding mixture). However, and even if the fibers 6 are wetted while they rise and while they dwell in the upper end positions, the overall effect of the mixture upon tobacco in the chambers 15*a* and 15*b* is invariably such that the moisture content of fibers 6 which enter the cooling unit 3 is much less than the moisture content of fibers which leave the conditioning unit 1. As a rule, the moisture content of fibers 6 which advance through the drying unit 2 is reduced to a value (e.g., 11 to 13 percent) which matches or is only slightly above the desired or optimum final moisture content, e.g., the optimum moisture content for introduction of fibers 6 into the magazine of the distributor in a cigarette maker.

Figure 2:
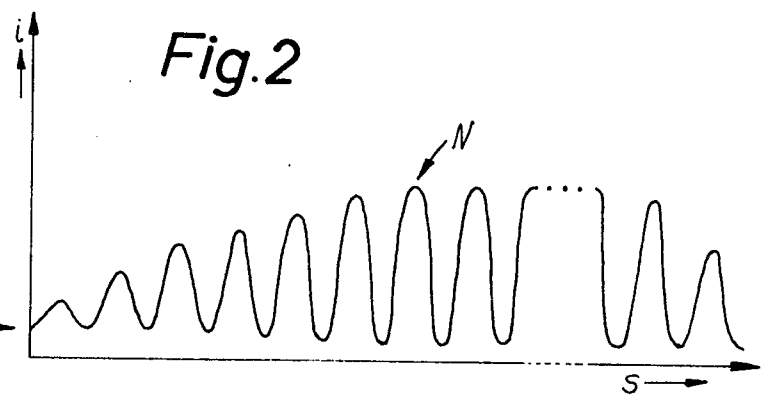
FIG. 2 is a diagram wherein the intensity of drying action is measured along the ordinate and the interval of drying is measured along the abscissa.

The diagram of FIG. 2 illustrates one mode of treating the fibers 6 during travel through the drying unit 2. The drying intensity i (i.e., the rate of withdrawal of water per unit of time) is measured along the ordinate, and the duration s of dwell of fibers 6 in the chambers 15*a*, 15*b* is measured along the abscissa. The curve N of FIG. 2 shows that the intensity i varies between higher and lower values as a result of up and down movements of fibers 6 on their way from the right-hand end wall of the chamber 10 toward the cooling unit 3. The intensity i is highest when the fibers 6 are closely adjacent to the bottom wall of the conveyor 8 in the chambers 15*a*, 15*b*, i.e., in the lower end positions of the fibers, and the intensity decreases as the fibers rise toward the sieve 22*a* or 22*b*. When the drying unit 2 is operated in a manner to treat the fibers 6 as represented by the curve N of FIG. 2, the fibers are dried (i.e., their moisture content is reduced) during each and every stage of travel through the unit 2. It will be noted that the minimum drying intensity i is close to zero.

Figure 3:
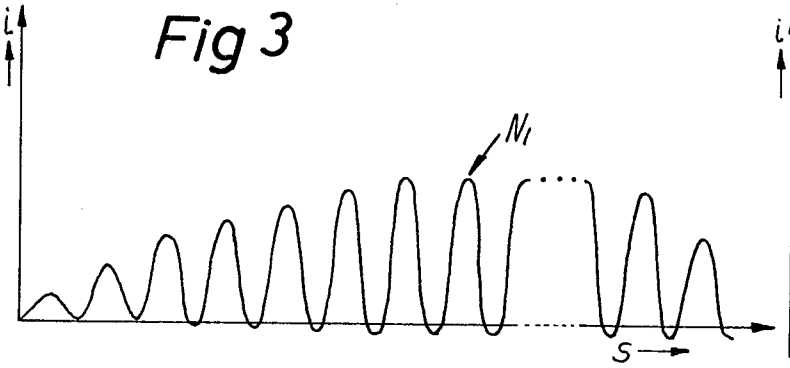
FIG. 3 is a similar diagram but showing a different mode of drying which includes alternately drying and slightly wetting the fibers.

The diagram of FIG. 3 represents a different mode of operating the drying unit 2, i.e., a different mode of expelling moisture from fibers 6 during travel through the chambers 15*a* and 15*b*. The aforementioned parameters are selected in such a way that, at least during travel through the chamber 15*b*, the fibers 6 are actually wetted when they rise to a level close to the sieve 22*b*, i.e., their moisture content increases when they move upwardly and away from the conveyor 8. However, and as can be readily seen by looking at the curve $N_1$ of FIG. 3, the overall effect is such that the moisture content of fibers is reduced during travel through the drying unit because the drying effect in the region or regions close to the upper side of the bottom wall of the conveyor 8 is much more pronounced than the wetting or moisture-admitting effect upon fibers which rise toward the sieve 22*a* and/or 22*b*.

Repeated and rapidly following movements of fibers 6 from the zones wherein the drying effect is pronounced into the zones wherein the drying effect is less pronounced (this includes zero drying effect or negative drying effect) results in pronounced crimping or curling of treated material. Such curling or crimping is highly desirable in the manufacture of cigarettes because crimped shreds occupy more room than straight shreds. Thus, without increasing the weight of tobacco which is used for the making of a cigarette, the manufacturer can produce a filler which enhances the "feel" or firmness of the finished product. Moreover, intensive wetting of fibers during travel through the conditioning unit 1 results in at least some swelling or puffing, i.e., in an increase of the volume of discrete fibers. Such swelling disappears, but only in part, during treatment in the drying unit 2 so that the volume of tobacco which is delivered to the cooling unit 3 is increased for two reasons, namely, as a result of crimping and also as a result of mere partial elimination of puffing which takes place in the unit 1.

The cooling unit 3 comprises a chamber 27 which confines a third portion of the vibratory conveyor 8. The side walls of the chamber 27 preferably diverge in the region above the bottom wall of the conveyor 8 in the same way as described above in connection with the side walls 21*a* and 21*b*. This insures that the speed of gaseous coolant (preferably air) which is admitted into the lower portion of the chamber 27 by a conduit 31 decreases while the coolant traverses the stream of fibers 6 which advance toward the belt conveyor 7. The conduit 31 receives cool air from a source 29 (e.g., a compressor for cool atmospheric air or a device which can compress as well as cool the air prior to admission into the conduit 31).

The temperature of fibers 6 which enter the chamber 27 is normally between 60° and 90° C. Such fibers travel across the ascending streamlets of cool air which pass through the apertures 11 of the conveyor 8 in the chamber 27 and whose velocity decreases owing to the aforementioned divergence of side walls above the conveyor. This insures that the cool air forms a turbulent layer in the region above the bottom wall of the conveyor 8 and that the fibers 6 which advance through such layer are subjected to a pronounced and uniform cooling action. As a rule, the temperature of fibers 6 which leave the chamber 27 is only slightly above room temperature. Moreover, treatment of fibers 6 in the chamber 27 entails a further reduction of moisture content so that the moisture content of fibers which descend onto the conveyor 7 equals or nearly matches the desired final moisture content.

Heated air which leaves the chamber 27 via conduit 24 (or at least a certain percentage of such air) is admitted to the source 19 to reduce the energy requirements of the apparatus. The chamber 27 contains a screen or sieve 32 which intercepts lighter fibers 6 to prevent entry of such fibers into the conduit 24.

EXAMPLE

The chute 4 was driven by the motor 5 to deliver a stream of fibers 6 at room temperature. Fibers which entered the chute 4 were delivered from a shredding machine wherein tobacco leaves were severed to yield shreds. The moisture content of fibers (shreds) 6 in the trough 4 was 22.65 percent. As a result of treatment in the chamber 10, the moisture content of fibers 6 was raised to 35.27 percent (i.e., by more than 50 percent), and the temperature of fibers leaving the chamber 10 after an interval of 5 seconds was 66° C. The nozzles 14 discharged hot water at a temperature of 80° C. and the conduit 12 supplied saturated steam which was produced in the source 13. The thus conditioned fibers were admitted into the drying unit 2. The temperature of the mixture in the chambers 15*a*, 15*b* was 170° C. and the moisture content of such mixture was 300 grams per kilogram of dry air. The total period of dwell of fibers 6 in the chambers 15*a*, 15*b* was 9 seconds. The temperature of fibers leaving the chamber 15*b* was 88° C. and their moisture content was reduced from 35.27 to 14 percent. During travel through the chamber 27, the fibers were cooled to a temperature of 26° C. and their moisture content was reduced to 12.84 percent.

A comparison of the filling effect of fibers which were treated in the apparatus of the present invention with that of fibers which were treated in accordance with previously known techniques indicates that the filling effect of fibers issuing from the cooling chamber 27 is much higher. The filling effect was measured in a conventional device, namely a cylinder for reception of a unit quantity of fibers. The unit quantity was thereupon compacted by a weight. The volume of 20 grams of compacted fibers 6 issuing from the cooling unit 3 was 166 ml.

A sample of air-dried tobacco whose initial moisture content was the same as that of tobacco in the aforedescribed Example (i.e., 22.65 percent) was condensed in the same cylinder and by the same weight to a volume of 121 ml, i.e., to less than 75 percent of the volume of tobacco which was treated in accordance with the improved method.

A further sample of tobacco which had the same initial moisture content (22.65 percent) but was dried in a fluidized bed dryer without alternating and rapidly following more and less pronounced drying yielded a compacted mass whose volume was 123 ml, i.e., less than 75 percent of the volume of tobacco which was dried in accordance with the method of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. A method of increasing the filling capacity of fibers which consist of smokable material, particularly tobacco, prior to confinement of fibers in containers, such as wrappers of cigarettes, comprising the steps of raising the moisture content of and simultaneously heating the fibers to thus increase the pliability of fibers; and thereupon drying the fibers including alternately expelling from the fibers moisture at a higher and lower rate per unit of time in rapid sequence.

2. A method as defined in claim 1, wherein said step of raising the moisture content includes abruptly raising the moisture content of fibers by at least 25 percent.

3. A method as defined in claim 1, wherein said drying step comprises alternately expelling moisture at a first rate which exceeds zero and at a second rate which at least approximates zero.

4. A method as defined in claim 1, wherein said drying step comprises alternately expelling moisture from and slightly wetting the fibers, the amount of moisture which is added in the course of wetting being less than the amount of moisture which is withdrawn from fibers during expulsion of moisture so that the moisture content of fibers upon completion of said drying step is less than prior to said drying step.

5. A method as defined in claim 1, wherein said step of raising the moisture content and heating comprises contacting the fibers with flowing steam and with droplets of hot water.

6. A method as defined in claim 5, wherein said steam is saturated steam and the temperature of said water droplets is between 50° and 90° C.

7. A method as defined in claim 5, further comprising the step of agitating the fibers during contact with steam and water droplets.

8. A method as defined in claim 1, wherein said drying step comprises contacting the fibers with a fluid stream including a mixture of a hot gas and superheated water vapors, said stream having first and second portions wherein the drying effect of said mixture is respectively more pronounced and less pronounced and said drying step further comprising alternately contacting the fibers in rapid sequence with said first and second portions of said stream.

9. A method as defined in claim 8, wherein said gas is air.

10. A method as defined in claim 8, wherein the starting temperature of said stream is between 150° and 210° C. and the initial moisture content of said stream is between 200 and 400 grams of water per kilogram of dry gas.

11. A method as defined in claim 8, wherein the drying effect of said second portion of said mixture at least approximates zero.

12. A method as defined in claim 8, wherein the drying effect of said second portion of said mixture is slightly negative so that the fibers receive moisture from said second portion of said mixture, the drying effect in said first portion of said mixture being more pronounced than the negative drying effect in said second portion so that the overall moisture content of fibers upon completion of said drying step is less than prior to said drying step.

13. A method as defined in claim 8, wherein said drying step further comprises conveying said stream upwardly, said second portion of said stream being located at a level above said first portion.

14. A method as defined in claim 13, wherein the drying effect of said mixture in said second portion of said stream approximates zero.

15. A method as defined in claim 13, wherein the drying effect of said mixture in said second portion of said stream is negative so that the fibers are wetted in said second portion, the drying effect in said first portion being more pronounced than the wetting of fibers in said second portion so that the moisture content of fibers upon completion of said drying step is less than prior to said drying step.

16. A method as defined in claim 8, further comprising the step of imparting to the fibers mechanical impulses in the course of said drying step to thereby move the fibers between said portions of said stream.

17. A method as defined in claim 8, further comprising the step of conveying said stream in a predetermined direction at a periodically varying speed.

18. A method as defined in claim 8, further comprising the steps of conveying said stream in a predetermined direction, increasing the cross-sectional area of said stream, as considered in said direction, and conveying the fibers across said stream whereby the fibers alternately rise and fall in rapid sequence during movement across said stream as a result of divergence of the stream in said direction, said second portion of said stream being located at a level above said first portion so that the fibers are subjected to less pronounced drying action while they rise and to more pronounced drying action as they fall in said stream.

19. A method as defined in claim 1, further comprising the step of cooling the fibers subsequent to completion of said drying step.

20. A method as defined in claim 19, wherein said cooling step comprises contacting the fibers with cold air.

21. A method as defined in claim 19, wherein said cooling step comprises establishing a turbulent layer of a cold gas and conveying the dried fibers through said layer.

22. Apparatus for increasing the filling capacity of fibers which consist of smokable material, particularly tobacco, prior to confinement of fibers in containers, such as wrappers of cigarettes, comprising a conditioning unit including means for raising the moisture content of and for simultaneously heating the fibers to thus increase the pliability of fibers; and a drying unit including means for alternately expelling from the heated and moisturized fibers moisture at a higher and lower rate per unit of time in rapid sequence.

23. Apparatus as defined in claim 22, wherein said expelling means includes means for alternately expelling moisture at a rate which exceeds and at a rate which at least approximates zero.

24. Apparatus as defined in claim 22, wherein said expelling means includes means for alternately expelling moisture at a rate which greatly exceeds zero and at a negative rate which involves a slight increase of moisture content of the fibers.

25. Apparatus as defined in claim 22, wherein said means for raising the moisture content of and for simultaneously heating the fibers comprises a source of hot water, means for conveying hot water from said source and for sprinkling droplets of hot water onto the fibers, a source of stream, and means for conveying steam from said last mentioned source into intimate contact with the fibers.

26. Apparatus as defined in claim 25, wherein said last mentioned source contains a supply of saturated steam and said first mentioned source includes means for maintaining the water at a temperature of between 50° and 90° C.

27. Apparatus as defined in claim 25, wherein said conditioning unit further comprises means for transporting the fibers along a predetermined path and means for converting the conveyed steam into a turbulent body in said path.

28. Apparatus as defined in claim 22, wherein said expelling means includes a source of a mixture of a hot gas and superheated water vapors, and means for conveying at least one stream of said mixture from said source into intimate contact with heated and moisturized fibers, said stream including first and second portions respectively having a more and less pronounced moisture expelling effect upon said fibers, said expelling means further comprising means for transporting the fibers across one of said portions and for intermittently propelling the fibers from said one portion into the other of said portions.

29. Apparatus as defined in claim 28, wherein said source includes means for maintaining said mixture therein at a temperature of 150°-210° C. and at a moisture content of between 200 and 400 grams water per kilogram of dry gas.

30. Apparatus as defined in claim 28, wherein said less pronounced moisture expelling effect at least approximates zero.

31. Apparatus as defined in claim 28, wherein said less pronounced moisture expelling effect is a negative effect which entails slight wetting of the fibers.

32. Apparatus as defined in claim 28, wherein said transporting means comprises a vibratory foraminous conveyor having an upper side, said first portion of said stream being adjacent to said upper side and forming a turbulent layer and said second portion being disposed at a level above said first portion, the velocity of said stream being such that the fibers on said conveyor are caused to alternately rise into said second portion and fall into said first portion of said stream.

33. Apparatus as defined in claim 32, wherein the moisture expelling effect of said second portion of said stream at least approximates zero.

34. Apparatus as defined in claim 32, wherein the moisture expelling effect of said second portion of said stream is a negative effect which entails slight wetting of fibers.

35. Apparatus as defined in claim 28, further comprising means for periodically varying the speed of said stream.

36. Apparatus as defined in claim 22, further comprising a third unit including means for cooling the fibers issuing from said drying unit.

37. Apparatus as defined in claim 36, wherein said cooling means comprises a source of gaseous coolant, means for transporting dried fibers along a predetermined path, and means for conveying a stream of gaseous coolant from said source and across said path.

38. Apparatus as defined in claim 37, further comprising means for reducing the speed of said coolant during travel across said path so that the coolant forms a turbulent layer for said fibers.

* * * * *